US009409708B1

(12) United States Patent
Watts

(10) Patent No.: US 9,409,708 B1
(45) Date of Patent: Aug. 9, 2016

(54) DUMPSTER LID OPENING SYSTEM

(71) Applicant: Gerald W. Watts, Clearwater, FL (US)

(72) Inventor: Gerald W. Watts, Clearwater, FL (US)

( * ) Notice: Subject to any disclaimer, the term of this patent is extended or adjusted under 35 U.S.C. 154(b) by 44 days.

(21) Appl. No.: 14/335,279

(22) Filed: Jul. 18, 2014

Related U.S. Application Data

(63) Continuation-in-part of application No. 13/894,336, filed on May 14, 2013, now abandoned, which is a continuation-in-part of application No. 13/454,214, filed on Apr. 24, 2012, now abandoned, which is a continuation-in-part of application No. 12/803,795, filed on Jul. 8, 2010, now Pat. No. 8,439,218.

(51) Int. Cl.
*B65D 43/26* (2006.01)
*B65F 1/14* (2006.01)
*B65F 1/16* (2006.01)

(52) U.S. Cl.
CPC ..... *B65F 1/163* (2013.01); *B65F 2001/1653* (2013.01)

(58) Field of Classification Search
CPC ..... B56F 1/163
USPC ..... 220/262, 263, 264
See application file for complete search history.

(56) References Cited

U.S. PATENT DOCUMENTS 963,079 A * 7/1910 Sebring ..... B65D 85/12 217/57
1,131,774 A * 3/1915 Davis ..... B65F 1/163 220/263
1,507,040 A * 9/1924 Zifferer ..... B65F 1/163 220/263
2,046,777 A * 7/1936 Geibel ..... B65F 1/08 220/23.87
2,120,520 A * 6/1938 Kamenstein ..... B65F 1/163 220/263
2,127,594 A * 8/1938 Grossman ..... A47B 77/14 206/223
2,419,163 A * 4/1947 Pope, Sr. ..... B65F 1/08 182/129
2,456,840 A * 12/1948 Rogers ..... B65F 1/163 220/263
2,736,454 A * 2/1956 McConnell ..... D06F 95/002 220/23.2
2,888,162 A * 5/1959 Herpich ..... B65F 1/1623 220/830
3,450,297 A * 6/1969 Clerk ..... B65F 1/163 220/263
4,526,288 A * 7/1985 Schuld ..... B65D 43/262 220/263
4,625,888 A * 12/1986 Thompson ..... B65D 90/623 220/262
5,011,036 A * 4/1991 Souza ..... B65F 1/163 220/263
5,158,198 A * 10/1992 Melideo ..... B65D 88/126 220/263

(Continued)

*Primary Examiner* — Fenn Mathew
*Assistant Examiner* — Chetan Chandra

(57) ABSTRACT

A container has a base plate and front and rear and side walls. A lid with a hinge is located above the front and rear and side walls. A pivot bar is attached to the lid. The pivot bar has a long extent and a short extent attached to the lid. An actuation assembly is coupled to the container and includes a lower component and a pedal secured to the lower component. The pedal is adapted to be depressed to move the lower component. An upper component is secured to the lower component for reciprocating movement in a plane parallel with the rear wall. A line has a lower end coupled to the upper component and an upper end coupled to the pivot bar.

3 Claims, 10 Drawing Sheets

(56) References Cited

U.S. PATENT DOCUMENTS 6,039,200 A * 3/2000 Armor ..... B65F 1/163 220/263
6,138,855 A * 10/2000 Kopf ..... B65F 1/1623 220/263
6,209,744 B1 * 4/2001 Gill ..... B65F 1/163 220/263
6,581,587 B1 * 6/2003 Helms ..... A47J 37/0704 110/178
6,789,537 B1 * 9/2004 Lutz ..... A47J 36/12 110/178
7,070,064 B1 * 7/2006 Henry ..... B65F 1/1623 220/262
7,108,148 B2 * 9/2006 Lu ..... B65F 1/1607 220/254.9
8,146,767 B1 * 4/2012 Grant ..... B65F 1/163 220/262
8,439,218 B1 * 5/2013 Watts ..... B65F 1/163 220/262
8,528,769 B1 * 9/2013 McKenna ..... B65F 1/1623 220/236
2004/0089663 A1 * 5/2004 Finkelstein ..... B65F 1/163 220/263
2004/0206758 A1 * 10/2004 Lin ..... B65F 1/163 220/263
2009/0321449 A1 * 12/2009 Arthurson ..... B65F 1/163 220/263
2011/0120997 A1 * 5/2011 Most ..... B65F 1/163 220/263
2011/0280694 A1 * 11/2011 Al-Hadhoud ..... B65F 1/1607 414/303
2013/0134167 A1 * 5/2013 Burleson ..... B65F 1/163 220/263

* cited by examiner 100
14
22
16
18
20
24
26
30
32
36
38
40
104
106
108
110
112
114
118
130
132
136
138
7
8

22
30
30
22
32
32
14
24
20
110
106
114
108
108
38
36
138
136
108
132
112
106

20
130
132
126
124
104
120
118
106
108
16
122

DUMPSTER LID OPENING SYSTEM

RELATED APPLICATION

The present application is a continuation-in-part of pending U.S. patent application Ser. No. 13/894,336 filed May 14, 2013, which is, in turn, is a continuation-in-part of abandoned U.S. patent application Ser. No. 13/454,214 filed Apr. 24, 2012, which is, in turn a continuation-in-part of U.S. patent application Ser. No. 12/803,795 filed Jul. 8, 2010 and issued May 14, 2013 as U.S. Pat. No. 8,439,218, the subject matter of which applications is incorporated herein by reference.

BACKGROUND OF THE INVENTION

Field of the Invention

The present invention relates to a dumpster lid opening system and more particularly pertains to raising and lowering dumpster lids hands free, solely through foot pedals, the raising and lowering being done in a safe, sanitary, convenient and economic manner.

SUMMARY OF THE INVENTION

In view of the disadvantages inherent in the known types of lid opening systems of known designs and configurations now present in the prior art, the present invention provides an improved dumpster lid opening system. As such, the general purpose of the present invention, which will be described subsequently in greater detail, is to provide a new and improved dumpster lid opening system which has all the advantages of the prior art and none of the disadvantages.

To attain this, the present invention essentially comprises a dumpster lid opening system. A container has a base plate and front and rear and side walls. A lid with a hinge is located above the front and rear and side walls. A pivot bar is attached to a lid. The pivot bar has a long extent and a short extent attached to the lid. An actuation assembly is coupled to the container and includes a horizontal bar and a pedal secured to the horizontal bar. The pedal is adapted to be depressed to rotate the horizontal bar. An upper bar is secured to the horizontal bar for oscillating movement in a plane parallel with the rear wall. The upper bar is movable in an arcuate path toward and away from the side walls. A line has a lower end coupled to the upper bar and an upper end coupled to the pivot bar.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dumpster lid opening system which has all of the advantages of the prior art lid opening systems of known designs and configurations and none of the disadvantages.

It is another object of the present invention to provide a new and improved dumpster lid opening system which may be easily and efficiently manufactured and marketed.

It is further object of the present invention to provide a new and improved dumpster lid opening system which is of durable and reliable constructions.

An even further object of the present invention is to provide a new and improved dumpster lid opening system which is susceptible of a low cost of manufacture and which accordingly is then susceptible of low prices of sale, thereby making such dumpster lid opening system economically available.

Lastly, it is an object of the present invention is to provide a dumpster lid opening system for raising and lowering dumpster lids hands free, solely through foot pedals, the raising and lowering being done in a safe, sanitary, convenient and economic manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated various embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
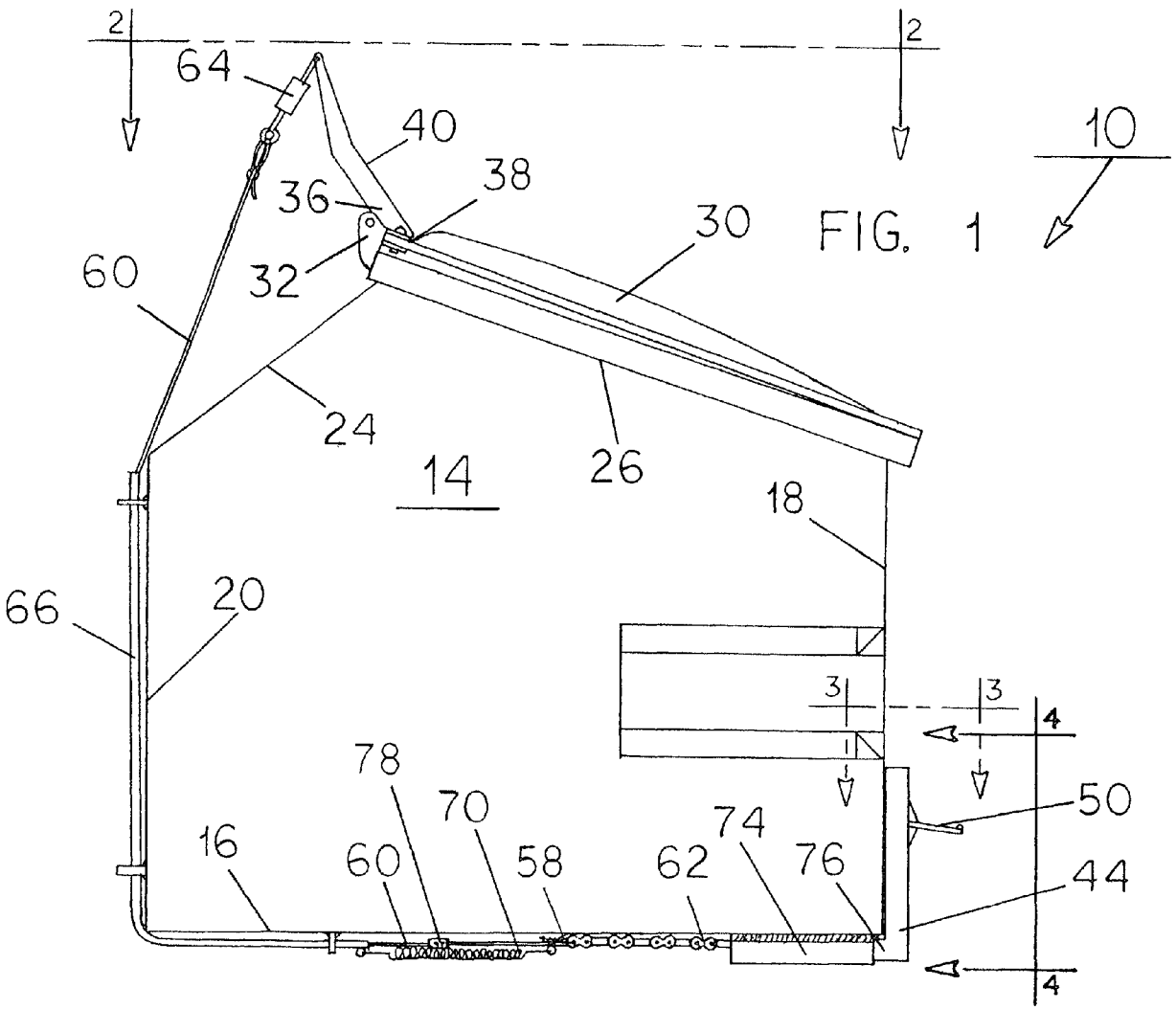
FIG. 1 is a side elevational view of a dumpster lid opening system constructed in accordance with the principles of the present invention.
Figure 3:
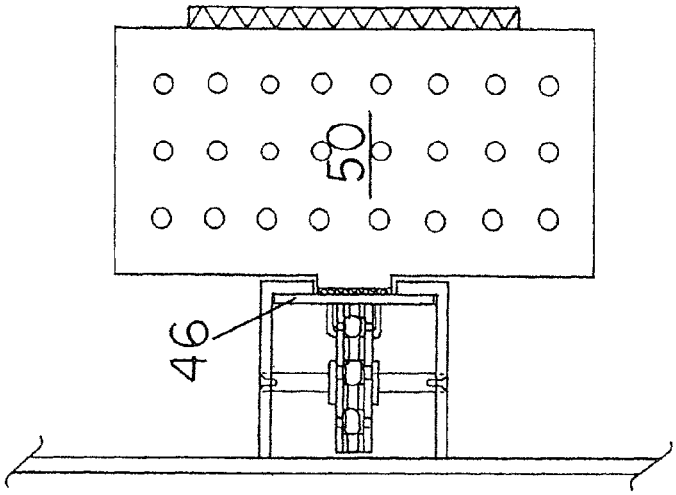
FIG. 3 is a cross sectional view taken along line 3-3 of FIG. 1.
Figure 2:
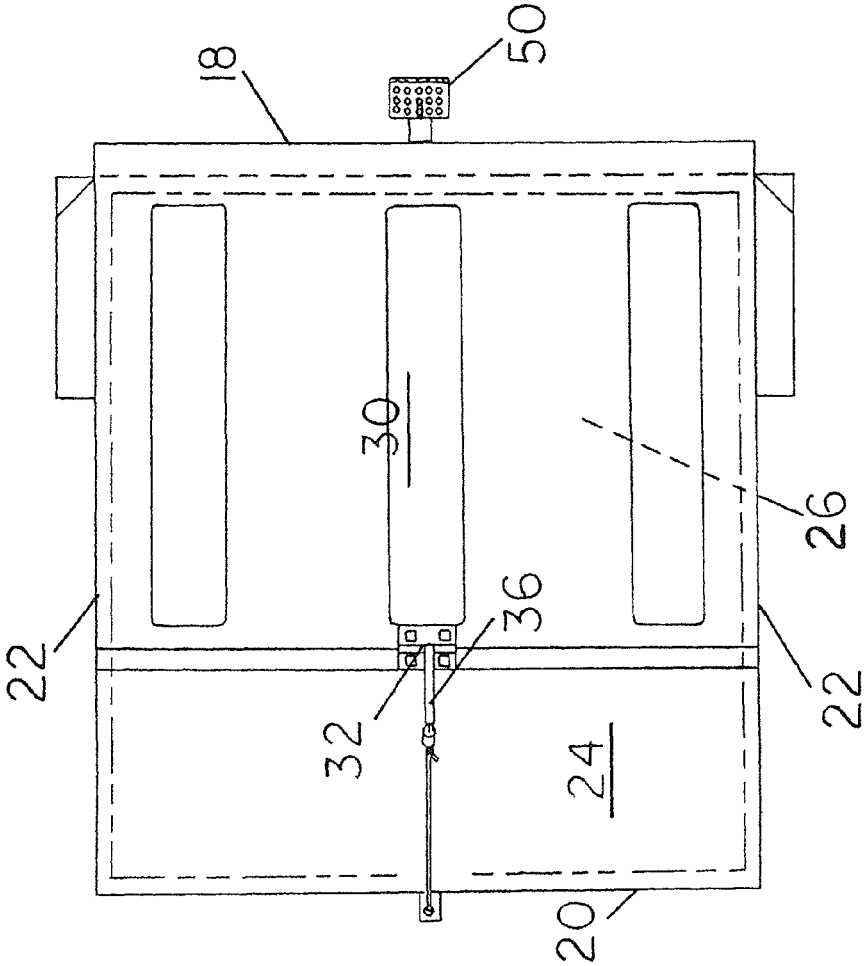
FIG. 2 is a plan view of the system taken along line 2-2 of FIG. 1.
Figure 5:
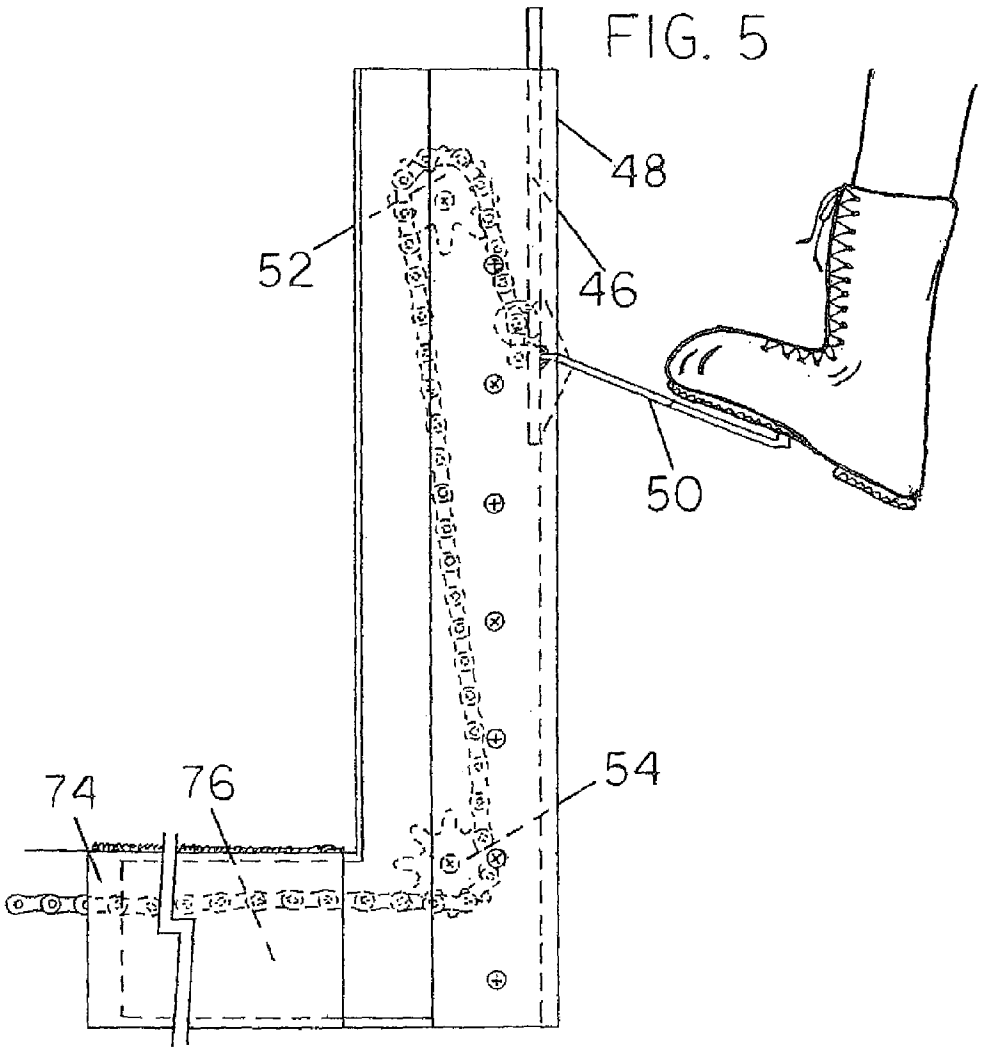
FIG. 5 is a side elevational view of a portion of the system taken along line 5-5 of FIG. 4.
Figure 4:
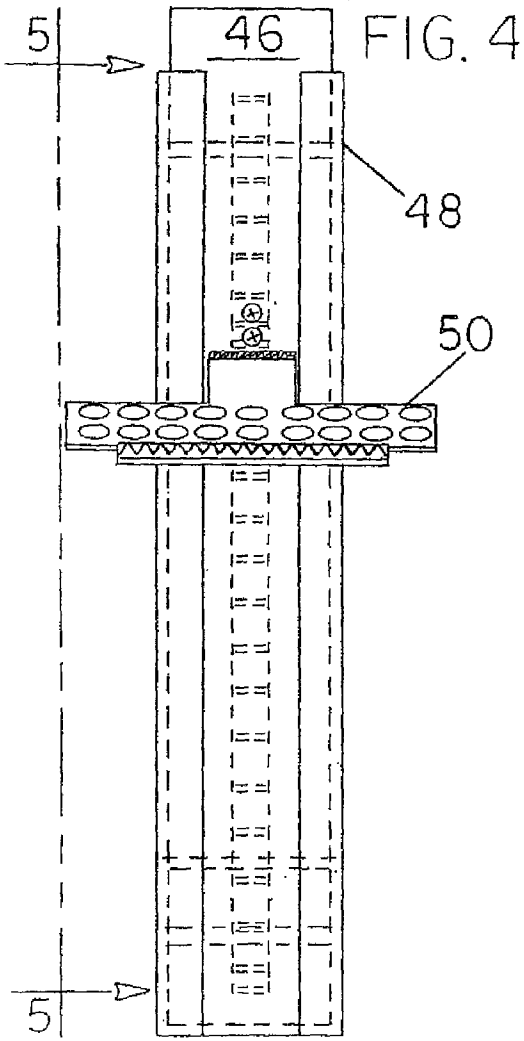
FIG. 4 is a front elevational view of a portion of the system taken along line 4-4 of FIG. 1.
Figures 6, 7:
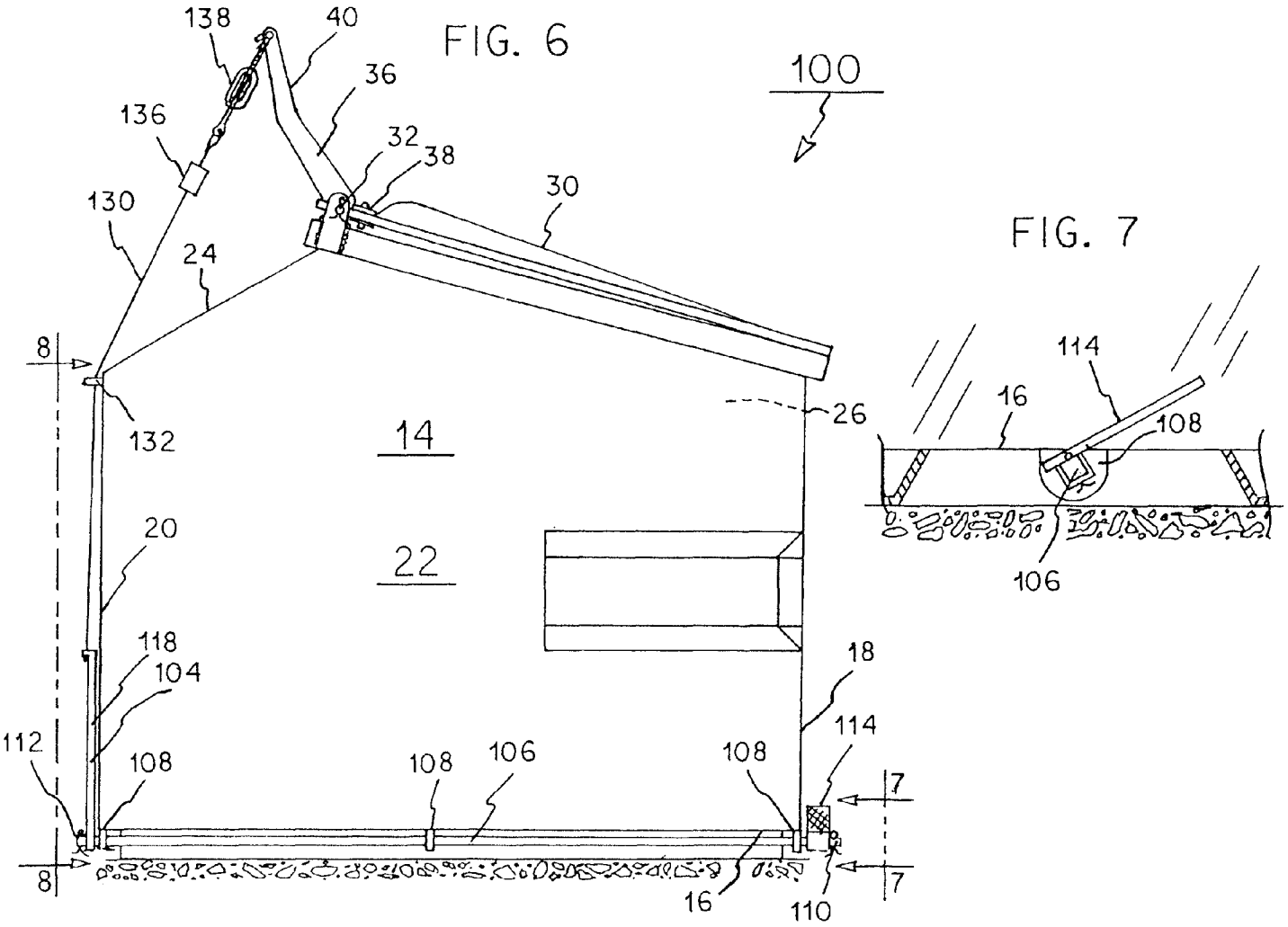
FIG. 6 is a front elevational view of dumpster lid opening system constructed in accordance with the primary embodiment of the present invention.
FIG. 7 is an enlarged front elevational view of a portion of the system taken along line 7-7 of FIG. 6.
Figures 8, 9:
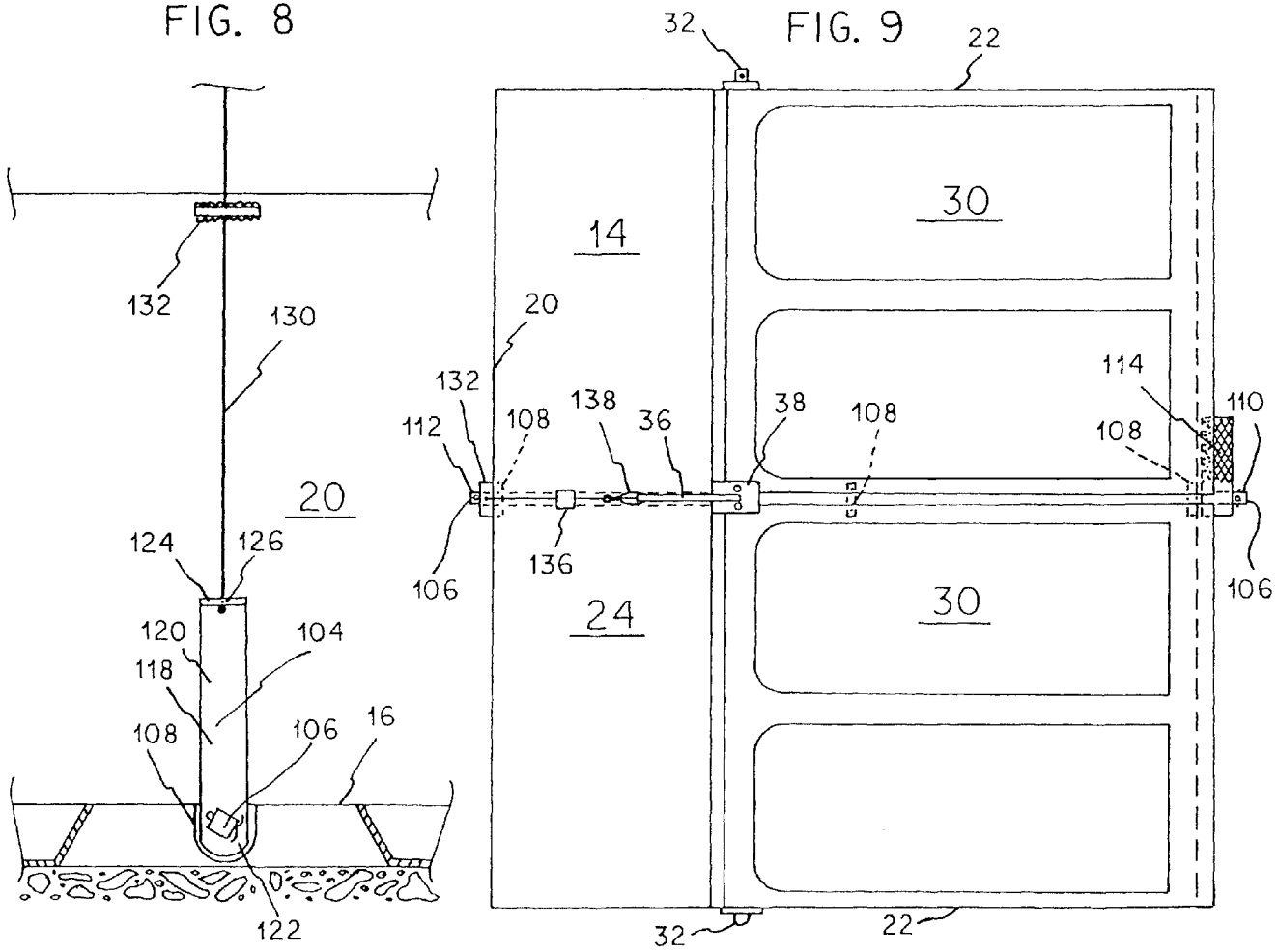
FIG. 8 is a rear elevational view of the system taken along line 8-8 of FIG. 6.
FIG. 9 is a plan view of the system illustrated in FIGS. 6, 7 and 8.
Figure 10:
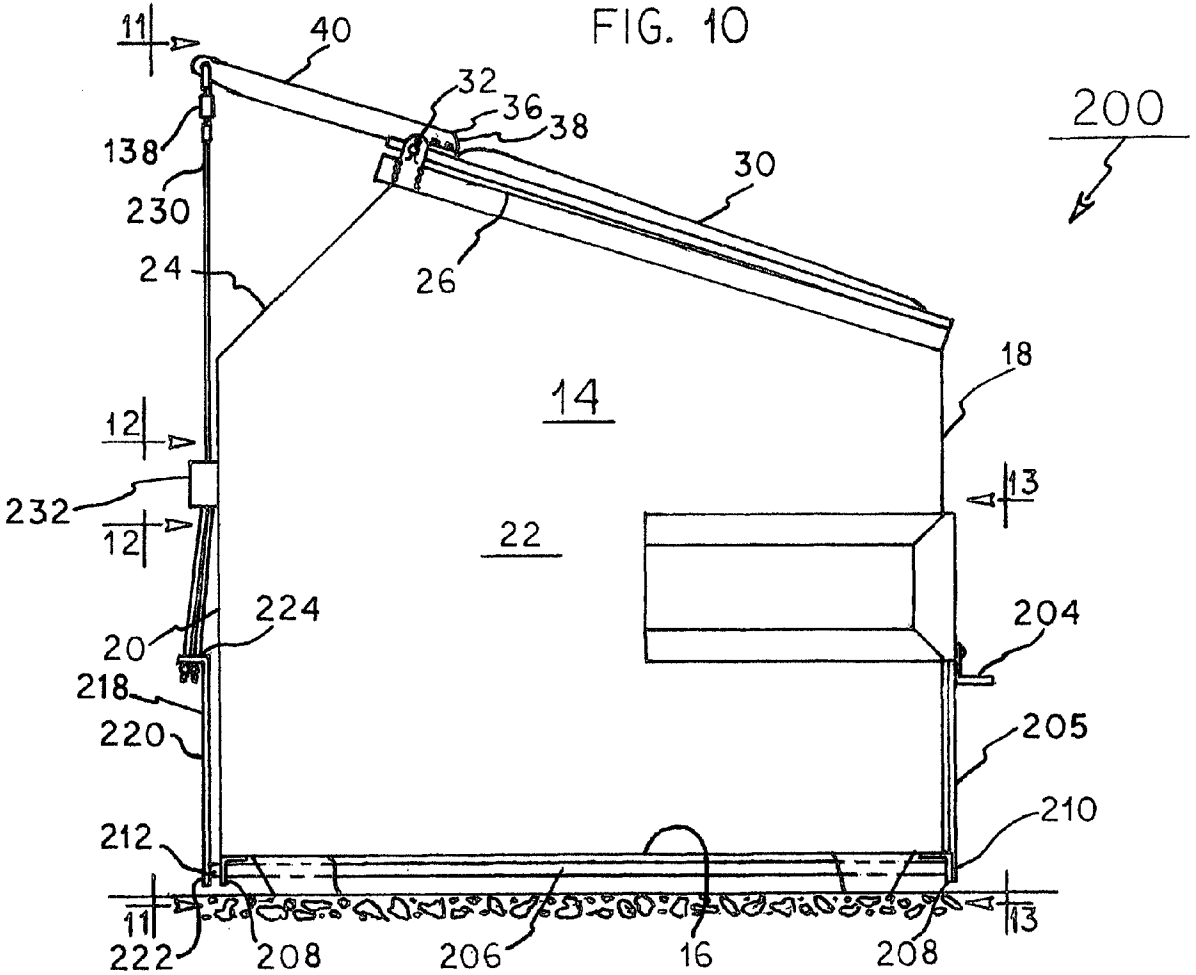
FIG. 10 is a side elevational view of the final embodiment of a dumpster lid opening system constructed in accordance with the principles of the invention.
Figure 12:
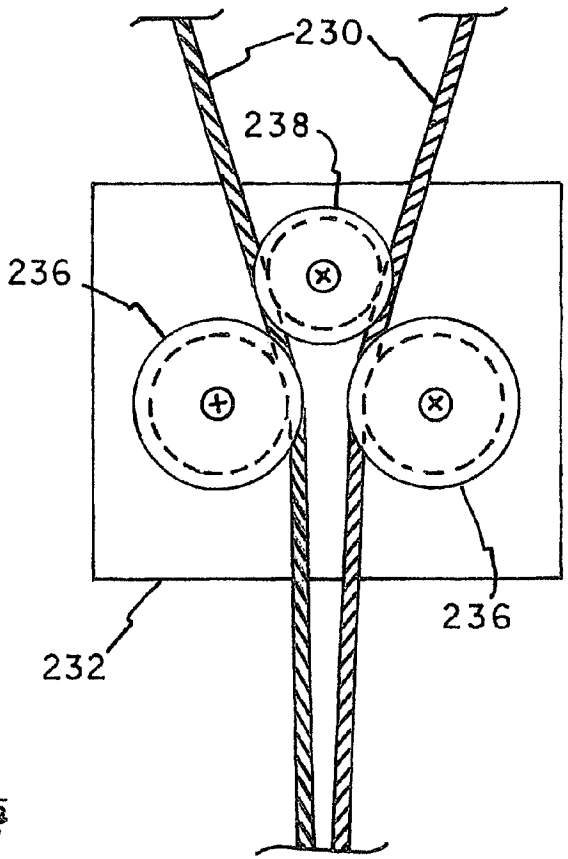
FIG. 12 is an enlarged elevational view of the guide assembly taken along line 12-12 of FIG. 10 but with the cover removed.
Figure 11:
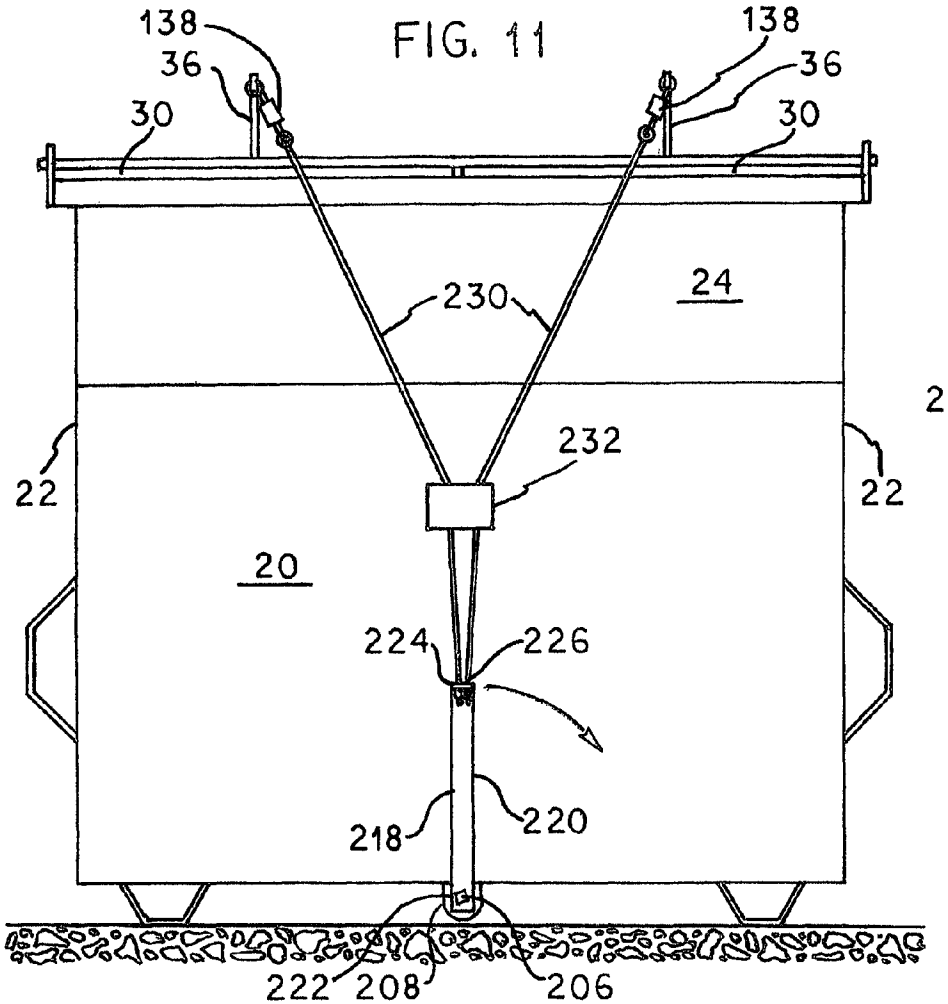
FIG. 11 is a rear elevational view taken along line 11-11 of FIG. 10.
Figure 13:
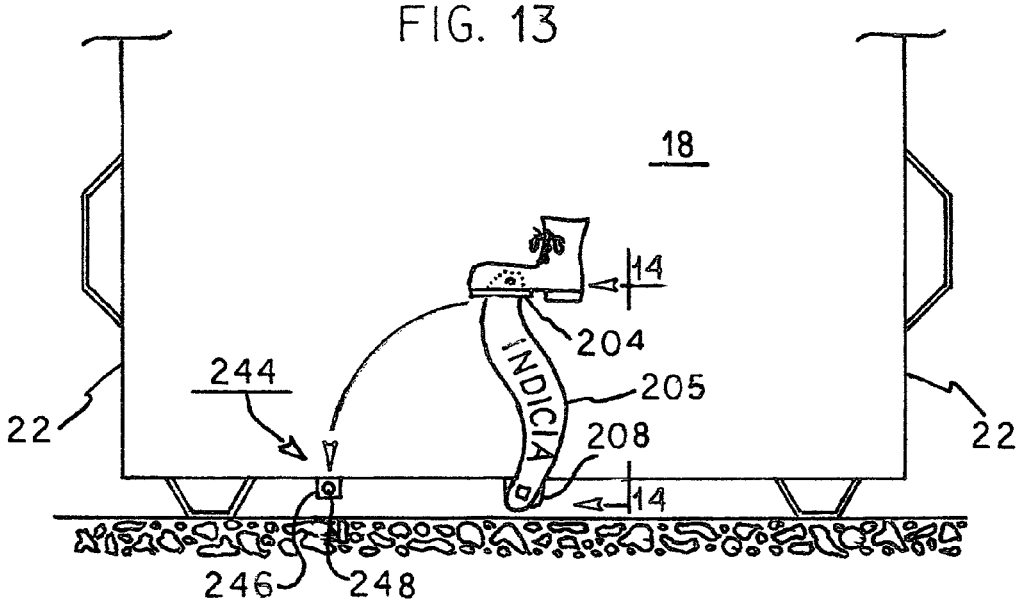
FIG. 13 is a front elevational view taken along line 13-13 of FIG. 10 but with the pedal raised.
Figure 14:
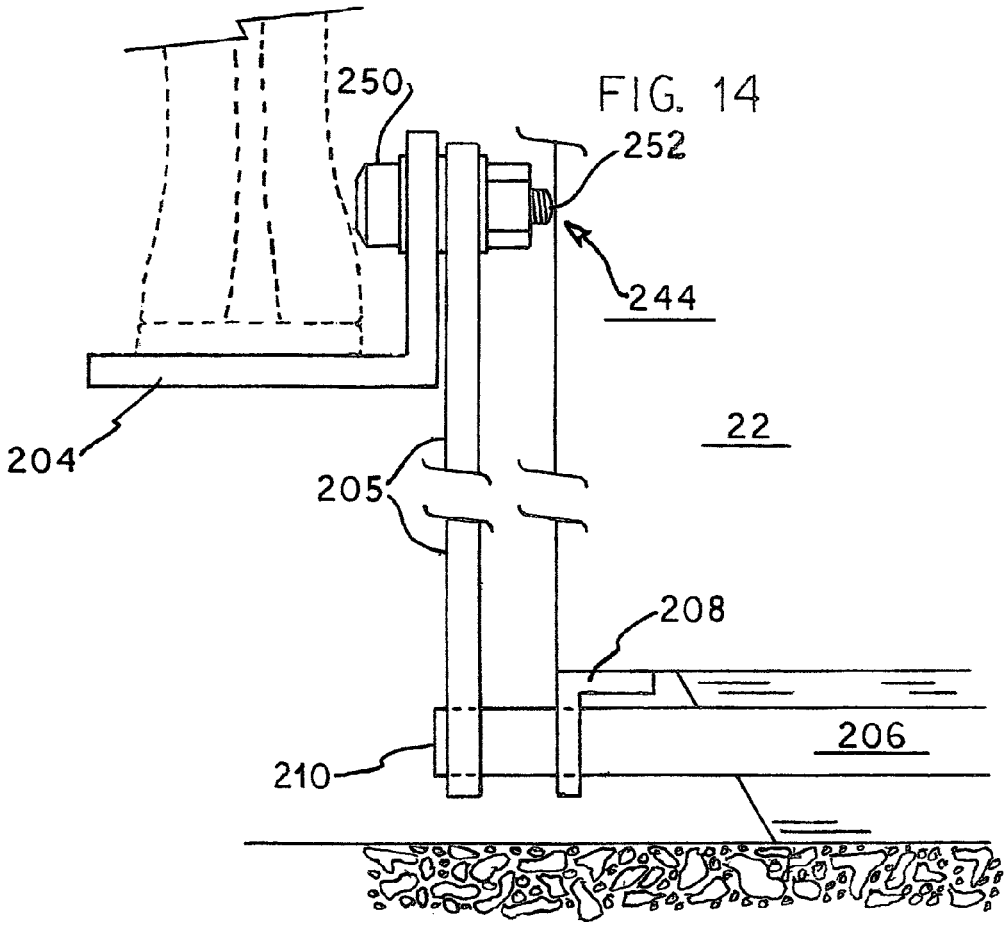
FIG. 14 is a side elevational view of the pedal taken along line 14-14 of FIG. 13.
Figure 15:
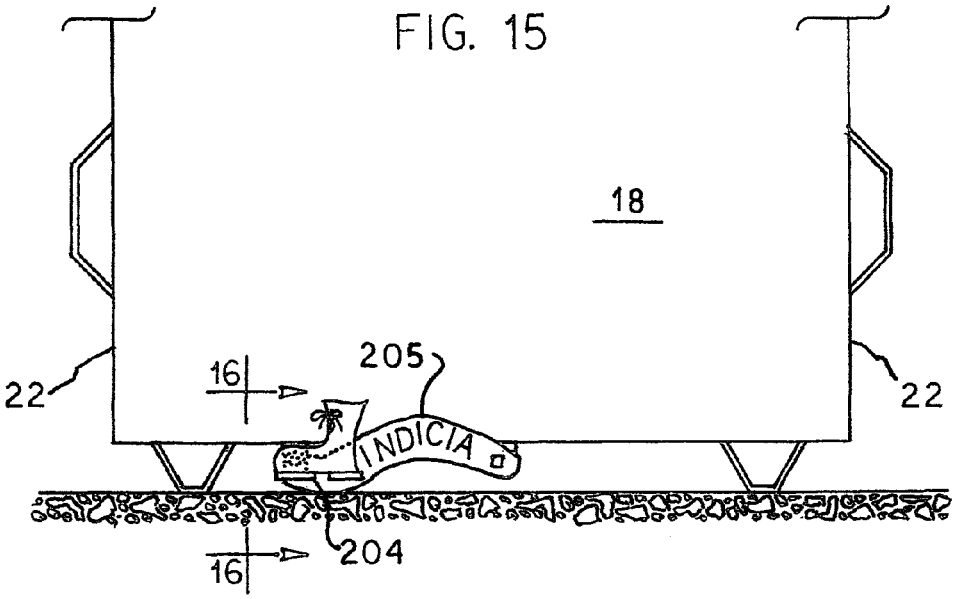
FIG. 15 is a front elevational view of the pedal with the pedal depressed.
Figure 16:
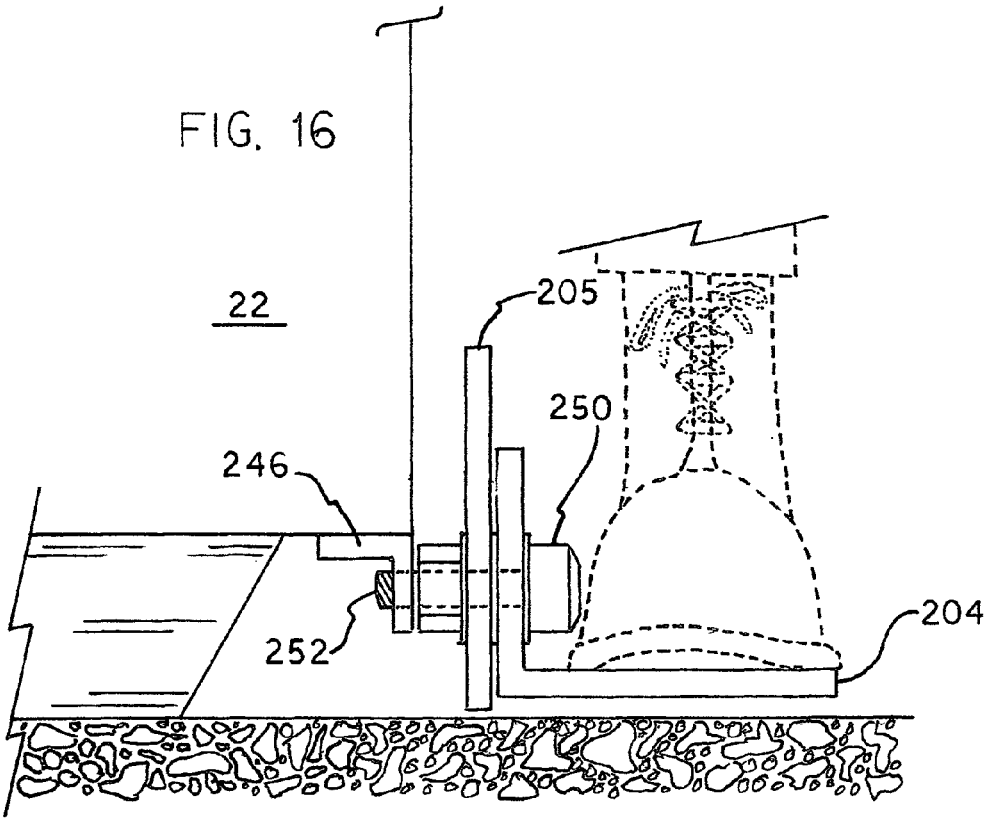
FIG. 16 is a side elevational view of the pedal taken along line 16-16 of FIG. 15.

With reference now to the drawings, and in particular to FIG. 1 thereof, a preferred embodiment of the new and improved dumpster lid opening system embodying the principles and concepts of the present invention and generally designated by the reference numeral 10 will be described.

The present invention, the dumpster lid opening system 10 is comprised of a plurality of components. Such components in their broadest context include a container, a lid, a pivot bar, an actuator, a pedal and a connector. Such components are individually configured and correlated with respect to each other so as to attain the desired objective.

First provided is a container 14. The container has a rectangular horizontal base plate 16. The container has a rectangular vertical front wall 18. The container has a rectangular vertical rear wall 20. The container has parallel, generally rectangular, vertical first and second side walls 22. The container has a top wall 24. The top wall extends forwardly and upwardly from the top edge of the rear wall. The side walls and the front wall and the top wall each have an upper edge. The front and top walls have a height. The top wall height is greater than the front wall height. The upper edges of the side walls are angled downwardly from the upper edge of the top wall to the upper edge of the front wall. In this manner a chamber is defined between the walls. The chamber has an open top 26.

A lid 30 is provided. A hinge 32 is also provided. The lid is located above the top wall intermediate the side walls. The lid is pivotably coupled to the hinge and the top wall. The lid is adapted to be pivoted between a lowered closed orientation and a raised vertical orientation. In the closed orientation, the lid covers the opening of the container. In the open orientation, the lid is provided above the rear wall.

A pivot bar 36 is provided. The pivot bar is attached to the lid. The pivot bar is located parallel with and spaced from the side walls. The pivot bar has a short extent 38. The short extent is attached to the lid. The pivot bar has a long extent 40. The long extent extends upwardly and rearwardly from the short extent at an angle of about 30 degrees, plus or minus 10 percent.

An actuator housing 44 is provided. The actuator housing is separable from the container. The actuator housing is provided beneath the container adjacent the front wall. A trolley 46 is provided. The trolley is provided in the actuator housing. The trolley is movable between a top rest position and a bottom operational position. Side brackets 48 are provided. The side brackets are adapted to constrain and guide the movement of the trolley. A pedal 50 is provided. The pedal is coupled to the trolley. The pedal is adapted to be depressed by a user to the bottom operational position. The pedal is adapted to be slid to a bottom operative position by a foot of the user. An upper sprocket 52 is provided. A lower sprocket 54 is also provided. The sprockets are rotatable in the housing. The upper sprocket is located above the top rest position of the pedal. The lower sprocket is located below the bottom operational position of the pedal. The actuator housing has a horizontal extension.

A flexible connector 58 is provided next. The flexible connector has an interior end. The interior end is attached to the trolley. The flexible connector has an exterior end. The exterior end is attached to the long extent of the pivot bar. The flexible connector is formed as a cable 60 and a chain 62. The cable extends from the pivot bar then extending generally vertically adjacent to the rear wall then horizontally beneath the base plate. A counterweight 64 is provided. The counterweight is provided between the cable and the pivot bar. A tube 66 is provided. The tube extends vertically adjacent to the rear wall then horizontally beneath the base plate. The tube is adapted to guide the movement of the cable. The chain is coupled from the cable around the lower sprocket and then around the upper sprocket and then to the trolley. In this manner the depression of the pedal will move the connector. Also in this manner the lid will be raised. Release of the pedal will cause the lid to lower under the force of gravity and the trolley and pedal. In this manner the lid will rise to the upper position.

Further provided is a coil spring 70. The coil spring couples the tube and the cable. In this manner the movement of the lid and connector upon depressing and releasing the pedal is cushioned.

Provided last is a separation assembly. The separation assembly includes a horizontal receptor 74. The horizontal receptor is provided below the container. The separation assembly includes a horizontal extension 76. The horizontal extension is provided on the actuator housing. The horizontal extension is removably received in the horizontal receptor. The separation assembly also includes a connector 78. The connector is provided in a central extent of the cable. In this manner the housing and chain and a portion of the cable are allowed to be separated from the container.

Reference in now had to the primary embodiment of the invention illustrated in FIGS. 6 through 9. In such embodiment there is illustrated a dumpster lid opening system 100 for raising and lowering dumpster lids hands free, solely through a foot pedal. The raising and lowering is done in a safe, sanitary, convenient and economic manner. First provided is a container 14 having a rectangular horizontal base plate 16 and a rectangular vertical front wall 18 and a rectangular vertical rear wall 20 and parallel, generally rectangular, vertical first and second side walls 22. A top wall 24 extends forwardly and upwardly from the rear wall. The side walls and the front wall and the top wall each having an upper edge with the front and top walls having a height. The top wall height is greater than the front wall height. The upper edges of the side walls are angled downwardly from the upper edge of the top wall to the upper edge of the front wall. The walls define a chamber there between with an open top 26.

Provided next is a lid 30 with a hinge 32 located above the top wall intermediate the side walls. The lid is pivotably coupled to the hinge and the top wall. The lid is adapted to be pivoted between a lowered closed orientation covering the opening of the container and a raised vertical open orientation above the rear wall.

A pivot bar 36 is attached to the lid and is located parallel with and spaced from the side walls. The pivot bar has a short extent 38 attached to the lid and a long extent 40 extending upwardly and rearwardly from the short extent at an angle of about 30 degrees, plus or minus 10 percent.

An actuation assembly 104 is operatively coupled to the container. The actuation assembly includes a lower bar 106. The lower bar has a square cross sectional configuration. The lower bar has fixed support brackets 108 rotatably securing the lower bar to the container beneath the base plate intermediate the side walls. The lower bar has a forward end 110 extending forwardly of the container. The lower bar a has rearward end 112 extending rearwardly of the container. A foot pedal 114 is secured to the horizontal bar adjacent to the forward end. The foot pedal is adapted to be depressed by a user to rotate the horizontal bar about the axis of rotation parallel with the side walls.

The actuation assembly also includes an upper bar 118 in an inverted L-shaped configuration. The upper bar has a long leg 120 having a lower end 122 secured to the horizontal bar adjacent to the rearward end for oscillating movement in a plane adjacent to and parallel with the rear wall. The upper bar has a short leg 124 with a securement aperture 126. The upper bar and the securement aperture being movable in an arcuate path of travel toward and away from the side walls.

The actuation assembly also includes a flexible line 130. The flexible line has a lower end operatively coupled to the securement aperture of the upper bar. The flexible line has an upper end operatively coupled to the long extent of the pivot bar. A fixedly positioned guide eyelet 132 is secured to the back plate above the upper bar. The guide eyelet is adapted to slidably receive the flexible line for allowing oscillating movement of the flexible line below the guide eyelet and axial movement of the flexible line above the guide eyelet.

Lastly provided are control components. The control components including a counterweight 136 operatively coupled to the flexible line between the guide eyelet and the pivot bar. The counterweight is adapted to counter balance the lid. The control components also include a turnbuckle 138 operatively coupled to the flexible line between the guide eyelet and the pivot bar. The turnbuckle is adapted to vary the effective length of the flexible line.

Reference is now has to the primary and preferred embodiment of the invention illustrated in FIGS. 10 through 16. In such embodiment there is illustrated a dumpster lid opening system 200 for raising and lowering dumpster lids 30 hands free, and for retaining the lids in the raised orientation also hands free, solely through the pedal 204. The raising and the lowering and the retaining being done in a safe, sanitary, convenient, and economical manner.

First provided is a container 14 having a rectangular horizontal base plate 16, and a rectangular vertical front wall 18, and a rectangular vertical rear wall 20, and parallel, generally rectangular, and vertical first and second side walls 22). A top wall 24 extends forwardly and upwardly from the rear wall. The side walls and the front wall and the top wall each have an upper edge with the front and top walls each having a height. The top wall height is greater than the front wall height. The upper edges of the side walls are angled downwardly from the upper edge of the top wall to the upper edge of the front wall. The walls define a chamber there between with an open top 26.

Provided next are two laterally spaced lids 30. Each lid has an associated hinge 32 located above the top wall intermediate the side walls. Each of the lids is pivotably coupled to the hinges and the top wall. Each of the lids is adapted to be pivoted between a lowered closed orientation covering the opening of the container and a raised vertical open orientation above the rear wall.

A pivot bar 36 is attached to each lid and is located parallel with and spaced inwardly from the side walls. The pivot bars each having a short extent 38 attached to the lids and a long extent 40 extending rearwardly from the short extents.

Next provided is an actuation assembly operatively coupled to the container. The actuation assembly includes a lower bar 206. The lower bar has a square cross sectional configuration. The lower bar has a central axis with fixed support brackets 208 coupling the lower bar to the container beneath the base plate intermediate the side walls. The lower bar has a forward end 210 extending forwardly of the container. The lower bar has a rearward end 212 extending rearwardly of the container. A foot pedal 204 includes a pivot leg 205 secured to the horizontal bar adjacent to the forward end. The foot pedal is adapted to be depressed by a user to rotate the horizontal bar about the central axis parallel with the side walls.

The actuation assembly also includes an upper connector 218 in an inverted L-shaped configuration. The upper connector has a long leg 220 with a lower end 222 secured to the horizontal bar adjacent to the rearward end for oscillating movement in a plane adjacent to and parallel with the rear wall. The upper connector has a short leg 224 with a securement aperture 226. The upper connector is movable in an arcuate path of travel toward and away from the side walls. The actuation assembly also includes two flexible lines 230). Each of the flexible lines has a lower end operatively coupled to the securement apertures of the upper connector. Each of the flexible lines has an upper end operatively coupled to the long extent of an associated pivot bar.

A fixedly positioned guide assembly 232 is secured to the back plate 36 above the upper connector. The guide assembly has two rollers 236 and a third guide 238 adapted to slidably receive the flexible lines for allowing oscillating movement of the flexible line below the guide assembly and axial movement of the flexible line above the guide assembly.

Control components are next provided and include a turnbuckle 138 operatively coupled to the flexible line between the guide assembly and the pivot bar. The turnbuckle is adapted to vary the effective length of the flexible line.

Lastly provided is a retention assembly 244 to hold the pedal in a lowered depressed orientation after initial depression by a user from a raised elevated orientation. The pedal is adapted to be released from the lower depressed orientation upon a subsequent movement by a user while in the lowered depressed orientation. The retention assembly includes a fixed block 246 centrally coupled to the base plate. The fixed block has an outwardly facing recess 248. A bolt 250 couples the peal to the pivot bar. The bolt has a free end 252 axially shiftable inwardly to an orientation in the recess to retain the lids up. The bolt is axially shiftable outwardly to an orientation out of the recess to allow movement of the lid downwardly under the weight of the lids.

Figure 17:
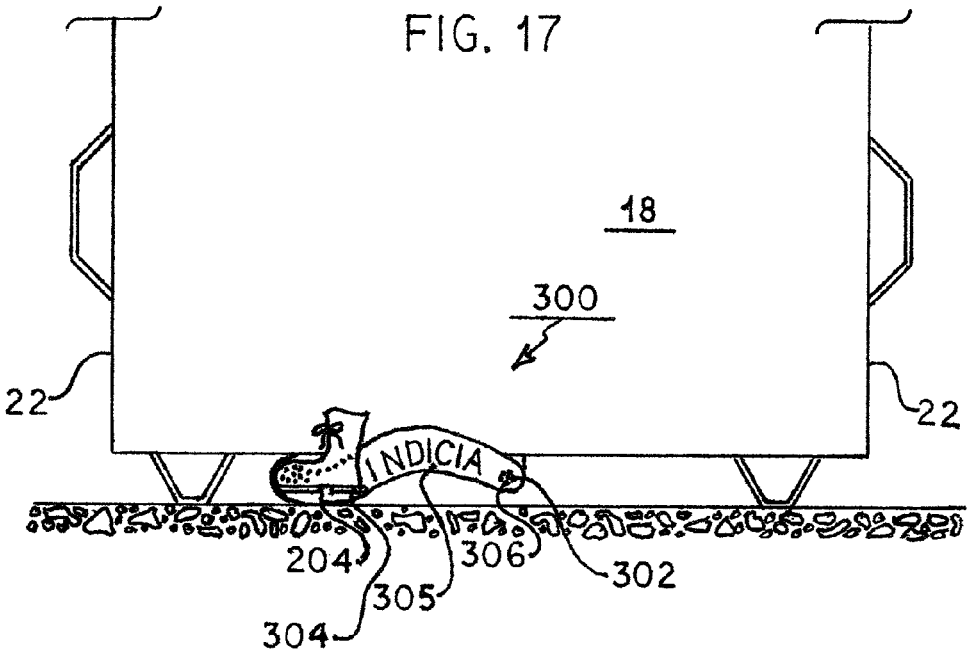
FIG. 17 is a front elevational view of the pedal and related components similar to FIG. 15 but constructed in accordance with a final alternate embodiment of the present invention.
Figure 18:
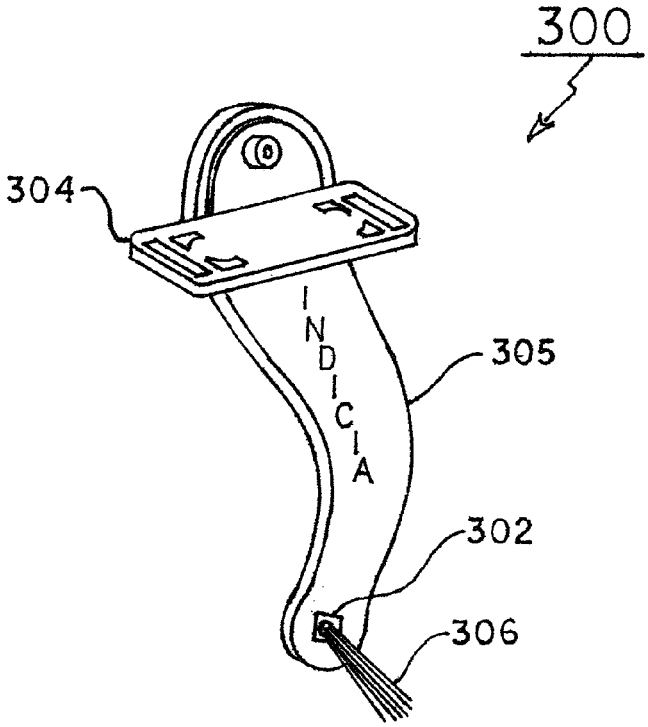
FIG. 18 is a perspective illustration of the pedal and related components shown in FIG. 17.

The final alternate embodiment of the invention is a system 300 as illustrated in FIG. 17. In such embodiment, the foot pedal 304 is operatively coupled to the lid or lids to be raised and lowered through a lower bar 302 as in the prior embodiments. Further, the foot pedal 304 includes the pivot leg 306 which rotatably couples the foot pedal and the lower bar. The foot pedal is adapted to be depressed by a user to rotate the horizontal bar about the central axis parallel with the side walls. The lower bar at the forward end includes a plug with forwardly extending flexible bristle 306. Such flexible bristles are of a length from 3 inches to 5 inches. Such flexible bristles function act as a detector during operation of the system. More specifically, during operation, a truck will couple to the system for lifting and tipping the container form refuse removal. Forward portions of the system including the foot pedal will approach the windshield of the truck and, in some instances, the windshield will be inadvertently contacted and cracked. The bristles when contacting the windshield will constitute a warning to an operator to reverse the lifting and tipping movement of the container and thus preclude cracking the windshield of the truck.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A dumpster lid opening system comprising;

a container having a base plate and front and rear and side walls, a lid with a hinge located above the front and rear and side walls, a pivot bar attached to the lid, the pivot bar having a long extent and a short extent attached to the lid;

an actuation assembly coupled to the container and including lower component, a pedal secured to the lower component, the pedal adapted to be depressed to move the lower component, the lower component having a forward end, the forward end including a plug with forwardly extending bristles adapted to function and act as a detector during operation of the system;

an upper component secured to the lower component for reciprocating movement in a plane parallel with the rear wall; and a line having a lower end coupled to the upper component and an upper end coupled to the pivot bar.

2. The system as set forth in claim 1 wherein the bristles are flexible with a length of from 3 inches to 5 inches.

3. A dumpster lid opening system (200) for raising and lowering dumpster lids (30) hands free, and for retaining the lids raised also hands free, solely through a foot pedal (204), the raising and lowering and retaining being done in a safe, sanitary, convenient and economic manner, the system comprising, in combination;

a container (14) having a rectangular horizontal base plate (16) and a rectangular vertical front wall (18) and a rectangular vertical rear wall (20) and parallel, generally rectangular, vertical first and second side walls (22), a top wall (24) extending forwardly and upwardly from the rear wall, the side walls and the front wall and the top wall each having an upper edge, the upper edge of the top wall being at a first elevation, the upper edge of the front wall being at a second elevation, the first elevation being greater than the second elevation, the upper edges of the side walls being angled downwardly from the upper edge of the top wall to the upper edge of the front wall, the walls defining a chamber there between with an open top (26);

the lids being two laterally spaced lids (30), each lid having an associated hinge (32) located above the top wall intermediate the side walls, each of the lids pivotably coupled to the hinges and the top wall, each of the lids adapted to be pivoted between a lowered closed orientation covering the opening of the container and a raised vertical open orientation above the rear wall;

a pivot bar (36) attached to each lid and located parallel with and spaced inwardly from the side walls, the pivot bars each having a short extent (38) attached to the lids and a long extent (40) extending upwardly and rearwardly from the short extents;

an actuation assembly operatively coupled to the container, the actuation assembly including a lower bar (206), the lower bar having a square cross sectional configuration with a central axis, the lower bar having fixed support brackets (208) coupling the lower bar to the container beneath the base plate intermediate the side walls, the lower bar having a forward end (210) extending forwardly of the container, the lower bar a having rearward end (212) extending rearwardly of the container, a foot pedal (204) with a pivot leg (205) secured to the horizontal bar adjacent to the forward end, the foot pedal adapted to be depressed by a user to rotate the horizontal bar about the central axis parallel with the side walls;

the actuation assembly also including an upper connector (218) in an inverted L-shaped configuration, the upper connector having a long leg (220) with a lower end (222) secured to the horizontal bar adjacent to the rearward end for oscillating movement in a plane adjacent to and parallel with the rear wall, the upper connector having a short leg (224) with securement apertures (226), the upper connector and the securement aperture being movable in an arcuate path of travel toward and away from the side walls;

the actuation assembly also including two flexible lines (230), each of the flexible lines having a lower end operatively coupled to the securement apertures of the upper connector, each of the flexible lines having an upper end operatively coupled to the long extent of an associated pivot bar, a fixedly positioned guide assembly (232) secured to the back plate (36) above the upper connector, the guide assembly having two rollers (236) and a third guide (238) adapted to slidably receive the flexible lines for allowing oscillating movement of the flexible line below the guide assembly and angled movement of the flexible line above the guide assembly;

control components including a turnbuckle (138) operatively coupled to each flexible line between the guide assembly and the pivot bars, the turnbuckles adapted to vary the effective length of the flexible lines; and a retention assembly (244) to hold the pedal in a lowered depressed orientation after initial depression by a user from a raised elevated orientation, the pedal adapted to be released from the lower depressed orientation upon a subsequent movement by a user wile in the lowered depressed orientation, the retention assembly including a fixed, block (246) centrally coupled to the base plate, the fixed block having an outwardly facing recess (248), a bolt (250) coupling the pedal to the pivot bar, the bolt having a free end (252) axially shiftable inwardly to an orientation in the recess to retain the lids up, the bolt being axially shiftable outwardly to an orientation out of the recess to allow movement of the lid downwardly.

* * * * *